US006774580B2

(12) United States Patent
Suzuki et al.

(10) Patent No.: US 6,774,580 B2
(45) Date of Patent: Aug. 10, 2004

(54) INVERTER CIRCUIT FOR A DISCHARGE TUBE

(75) Inventors: Shinichi Suzuki, Shizuoka-ken (JP); Yasuhiro Kamiya, Shizuoka-ken (JP); Koji Kawamoto, Tokyo (JP); Masakazu Ushijima, Tokyo (JP)

(73) Assignee: Minebea Co., Ltd., Nagano-ken (JP)

( * ) Notice: Subject to any disclaimer, the term of this patent is extended or adjusted under 35 U.S.C. 154(b) by 0 days.

(21) Appl. No.: 10/251,036

(22) Filed: Sep. 20, 2002

(65) Prior Publication Data

US 2003/0057873 A1 Mar. 27, 2003

(30) Foreign Application Priority Data

Sep. 21, 2001 (JP) ..... 2001-288748
Sep. 18, 2002 (JP) ..... 2002-271547

(51) Int. Cl.[7] ..... H05B 37/02

(52) U.S. Cl. ..... 315/224; 315/209 R; 315/307; 315/DIG. 7

(58) Field of Search ..... 315/224, 209 R, 315/244, 291, 307, DIG. 7; 361/78, 86, 1; 363/50, 56.01, 56.02, 56.08, 56.11

(56) References Cited

U.S. PATENT DOCUMENTS 5,495,405 A * 2/1996 Fujimura et al. ..... 363/133
6,130,833 A 10/2000 Sakamoto et al. ..... 363/131
6,184,631 B1 * 2/2001 Noma et al. ..... 315/224
6,259,615 B1 7/2001 Lin ..... 363/98
6,326,740 B1 * 12/2001 Chang et al. ..... 315/291
6,348,755 B1 2/2002 Shimamura et al. ..... 310/318
6,570,343 B1 * 5/2003 Shoji et al. ..... 315/224

FOREIGN PATENT DOCUMENTS

JP 2000058289 2/2000
JP 2000308358 11/2000
JP 2001086758 3/2001

OTHER PUBLICATIONS

European Patent Office; European Search Report; Jan. 17, 2003.

* cited by examiner

*Primary Examiner*—Wilson Lee
*Assistant Examiner*—Thuy Vinh Tran
(74) *Attorney, Agent, or Firm*—Thompson Coburn, LLP

(57) ABSTRACT

An inverter circuit for a discharge tube of the present invention comprises a transformer in which a resonance circuit is composed of a parasitic capacitance of a discharge tube, and a H-bridge circuit which drives the primary side of the transformer at a frequency that is lower than the resonance frequency of the resonance circuit and that involves a phase difference between the voltage and the current at the primary side of the transformer, the phase difference falling within a predetermined range from its minimum point.

25 Claims, 6 Drawing Sheets

7
12
19u
19d, 20d
18u
18d, 21d
20u
21u
18
19
20
21
t1
18, 19
20, 21

INVERTER CIRCUIT FOR A DISCHARGE TUBE

BACKGROUND OF THE PRESENT INVENTION

1. Field of the Present Invention

The present invention relates generally to an inverter circuit for a discharge tube for use in an LCD unit, and, more specifically, to an inverter circuit for a discharge tube, which ensures high power efficiency.

2. Description of the Related Art

Some conventional inverter circuits for a discharge tube operate such that the primary side of a transformer is driven by a resonance frequency of a resonance circuit at the secondary side of the transformer, which comprises a leakage inductance and a parasitic capacitance of a discharge tube connected as a load. Such an inverter circuit is disclosed in U.S. Pat. No. 6,114,814.

This drive by the resonance frequency involves a phase difference between voltage and current at the primary side of the transformer, so that power efficiency of the transformer is not necessarily satisfactory.

There is another problem that high-order resonance frequencies existing at the secondary side of the transformer cause an accidental operation that influences undesirably its operation, which gives difficulty in designing the transformer.

SUMMARY OF THE PRESENT INVENTION

The present invention has been made in view of the above problems. It is therefore an object of the present invention to provide an inverter circuit for a discharge tube that has an increased efficiency of a transformer and that is free from the influence of the high-order resonance frequencies.

In order to achieve the above object, it is noted that an excellent power efficiency can be obtained when the transformer is driven at a specific frequency range where the phase difference is small between voltage and current at the primary side of the transformer.

According to a first aspect of the present invention, an inverter circuit for a discharge tube comprises: a transformer which includes a resonance circuit composed of a parasitic capacitance of the discharge tube; and a H-bridge circuit which drives a primary side of the transformer at a frequency that is lower than a resonance frequency of the resonance circuit and that involves a phase difference between a voltage and a current at the primary side of the transformer, the phase difference falling within a predetermined range from its minimum point. Accordingly, the inverter circuit improves the power efficiency of the transformer, and suffers from little influence by the high-order frequencies, easing the transformer design.

According to a second aspect of the present invention, the predetermined range is preferably below the resonance frequency at the secondary side of the transformer and covers −30° from the minimum point. Accordingly, the inverter circuit improves reliably the power efficiency of the transformer.

According to a third aspect of the present invention, the inverter circuit for a discharge tube may further comprise a burst circuit that outputs a predetermined burst signal, whereby the primary side of the transformer is driven intermittently. Accordingly, light is modulated easily over a wide range.

According to a fourth aspect of the present invention, the burst circuit outputs an inputted pulsed signal as a burst signal when a resistance that determines an oscillating frequency is set to be higher than a predetermined value, and outputs a burst signal obtained from a predetermined DC signal and an oscillated triangular wave when the resistance is set to be lower than a predetermined value. Accordingly, the inverter circuit outputs easily a plurality of burst signals.

According to a fifth aspect of the present invention, when the burst signal goes high, an inverting input terminal of an error amplifier which feedback-controls a current of the discharge tube is pulled up, whereby the primary side of the transformer is inactivated. Accordingly, light is modulated easily and reliably over a wide range.

According to a sixth aspect of the present invention, the H-bridge circuit is composed such that two series circuits each comprising a PMOS and an NMOS are connected to each other in parallel, and a delay circuit is connected to gate circuits of the PMOSs. Accordingly, the PMOSs and NMOSs in the series circuits are prevented from turning on simultaneously, thereby preventing malfunction and protecting circuits According to a seventh aspect of the present invention, the H-bridge circuit is composed such that two series circuits each comprising a PMOS and an NMOS are connected to each other in parallel, and gates of two PMOSs are caused to rise at respective two points which correspond to the maximum peaks of a predetermined triangular wave output and which appear alternately with each other while gates of two NMOSs are caused to rise at respective two points which correspond to the minimum peaks of the triangular wave output and which appear alternately with each other. Accordingly, it is possible to generate an appropriate signal that is effective not to turn on PMOSs and NMOSs of the H-Bridge circuits simultaneously.

According to an eighth aspect of the present invention, the H-bridge circuit is composed such that two series circuits each comprising a PMOS and an NMOS are connected to each other in parallel, gates of two NMOSs are caused to fall at respective two points which correspond to crossings defined by ascending portions of a predetermined triangular wave output and a voltage output of the error amplifier and which appear alternately with each other, and gates of two PMOSs are caused to fall lagging behind falling of the gates of the two NMOSs. Accordingly it is possible to ensure that PMOSs and NMOSs are not caused to turn on simultaneously.

According to a ninth aspect of the present invention, a voltage feedback error amplifier is further provided for feedback-controlling an output voltage of the transformer. Accordingly it is possible to provide a constant open voltage of the transformer even in case of no or poor connection of a discharge tube to the output terminal of the transformer.

According to a tenth aspect of the present invention, a protection circuit is further provided for inactivating the H-bridge circuit when an output voltage of the error amplifier exceeds a predetermined value. According it is possible to prevent an overcurrent from flowing in the discharge tube or an overvoltage from being applied to the discharge tube.

According to an eleventh aspect of the present invention, a protection circuit is further provided for inactivating the H-bridge circuit when an output of the voltage feedback error amplifier exceeds a predetermined value. Accordingly, it is possible to ensure that any damages to the transformer or any circuits are prevented.

According to a twelfth aspect of the present invention, a protection circuit is further provided for inactivating the H-bridge circuit when an output of the transformer exceeds a predetermined value.

According to a thirteenth aspect of the present invention, the predetermined value defined in the eighth aspect of the present invention is a reference voltage of a comparator of the protection circuit.

BRIEF DESCRIPTION OF THE DRAWINGS

The above and other objects, aspects, features and advantages of the present invention will become more apparent from the following detailed description when taken in conjunction with the accompanying drawings, in which.

DESCRIPTION OF THE PREFERRED EMBODIMENT

The present invention will now be described with reference to the accompanying drawings.

First of all, an explanation will be given on the first embodiment by reference to FIGS. 1 to 5(A) to 5(F).

Figure 1:
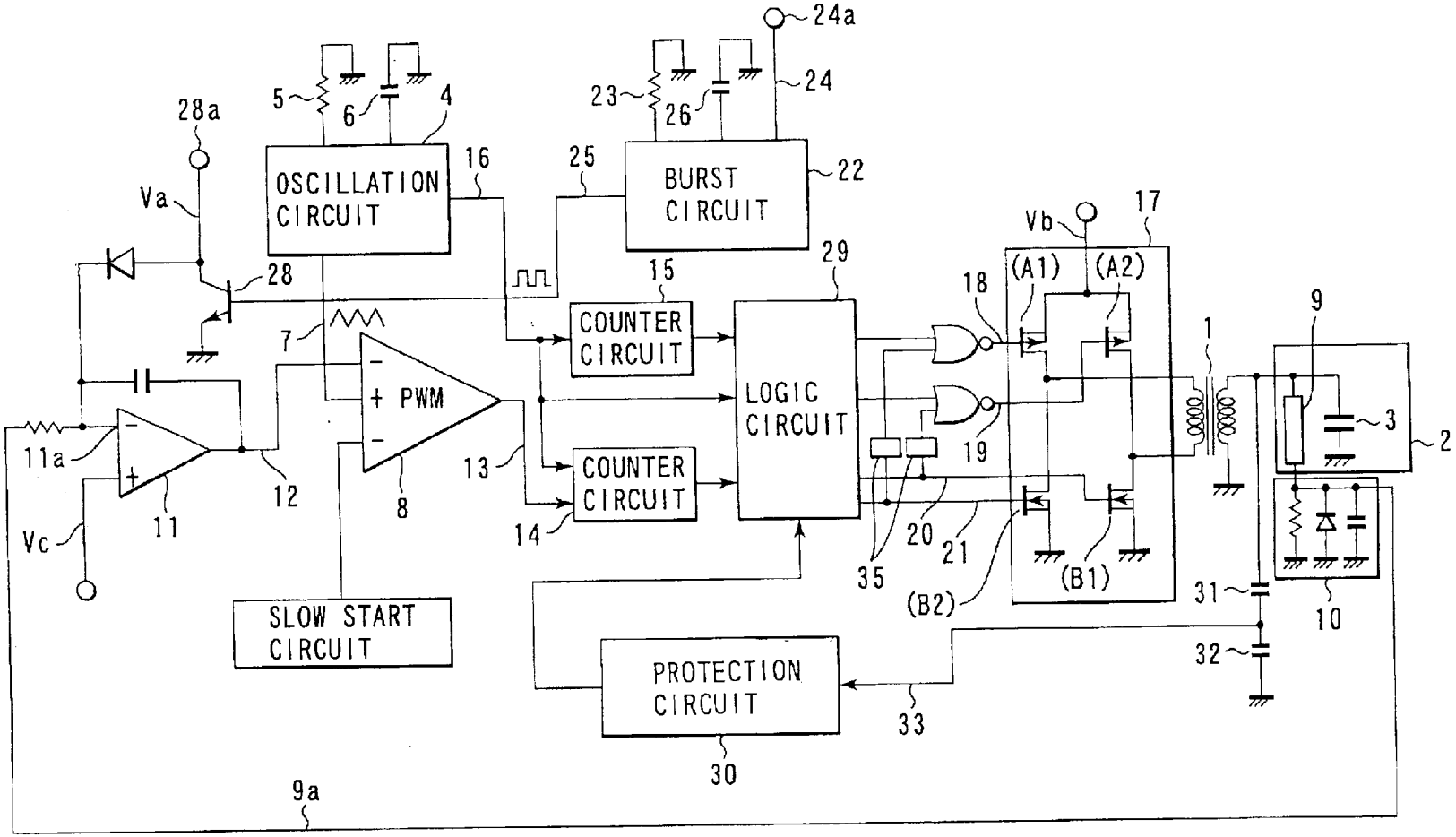
FIG. 1 is a block diagram of an inverter circuit for a discharge tube of a first embodiment according to the present invention.
Figure 3:
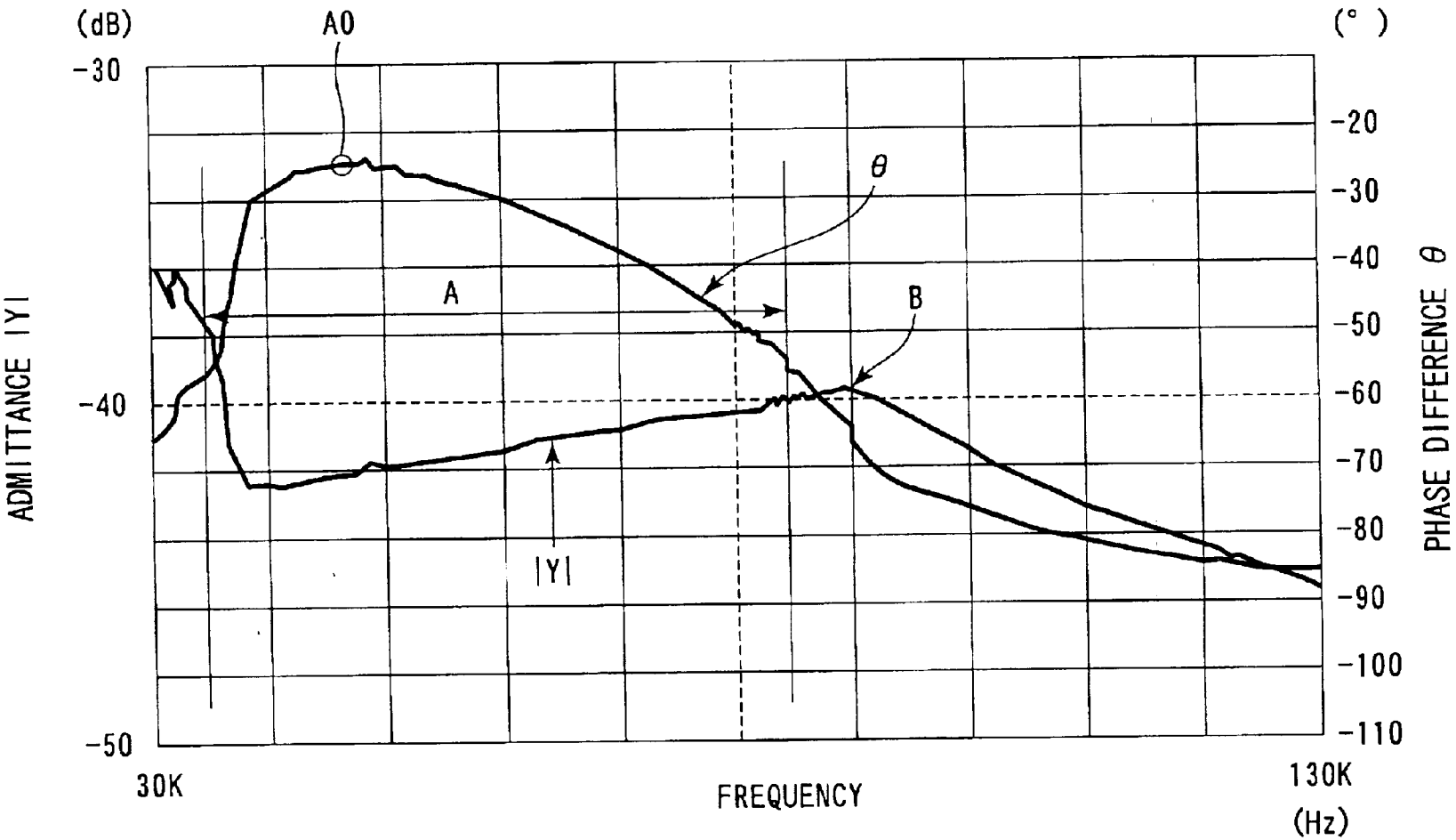
FIG. 3 shows frequency characteristics of the admittance |Y| at the primary side of a transformer with a resonance circuit formed at the secondary side in the inverter circuit for a discharge tube of the embodiment according to the present invention, and frequency characteristics of the phase difference θ between the voltage and the current.

Referring to FIG. 1, a resonance circuit is composed of a parasitic capacitance 3 generated between a discharge tube 9 and a reflector at the secondary side of a transformer 1. As shown in FIG. 3, the transformer 1 has a maximum power efficiency at the point A0 where the phase difference θ between the voltage and the current at the primary side is minimum. In the frequency range A to cover −30° from the point A0, the transformer 1 has a power efficiency comparable to the maximum obtained at the point A0, as seen in the measured data. The point B is a resonance frequency of the secondary side, at which the transformer 1 is conventionally driven. The resonance circuit at the secondary side of the transformer 1 may comprise either a choke coil (not shown) provided in series with the transformer 1 and the parasitic capacitance 3, or a part of the transformer 1 (for example, a loose coupling portion of a magnetic-leakage flux-type transformer) and the parasitic capacitance 3.

The values of a resistance 5 and a capacitor 6 of an oscillation circuit 4 shown in FIG. 1 are set so as to make the frequency fall within the range A.

The operation of the inverter circuit for a discharge tube of the first embodiment will be described with reference to FIGS. 1 to 4(A) to 4(E).

For better understanding, the description will be made first as for the case where a predetermined voltage Va at a terminal 28*a* is not inputted to an inverting input terminal 11*a* of an error amplifier 11, thereby failing to modulate light.

Figures 4A, 4B, 4C, 4D, 4E:
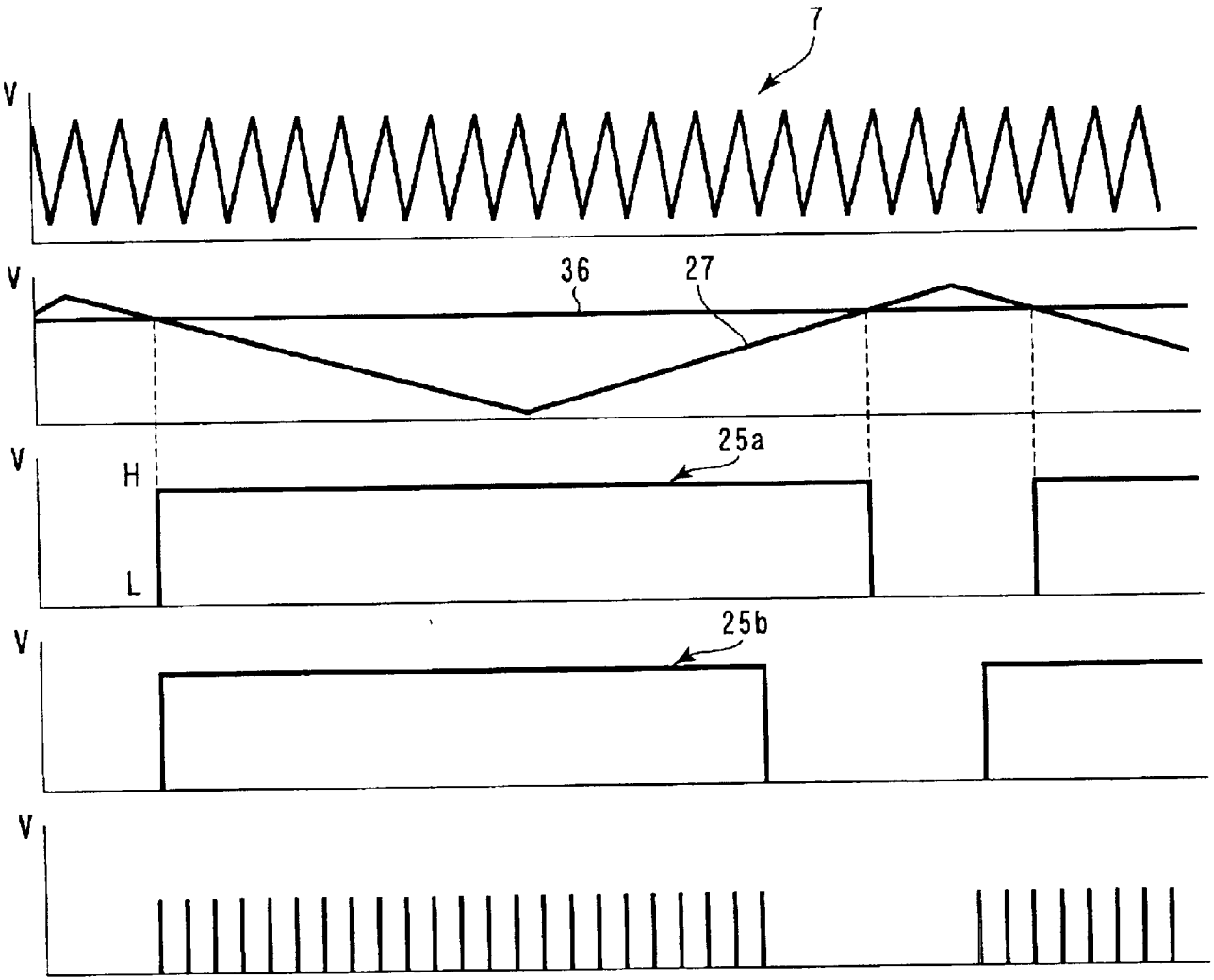
FIGS. 4(A) to 4(E) are timing charts of the operation of the inverter circuit for a discharge tube of the first embodiment according to the present invention.

As shown in FIG. 1, a triangular wave output 7 (see FIG. 4(A)) of the oscillation circuit 4 is inputted to a PWM circuit 8. A discharge tube 9 for back-lighting a liquid crystal is provided on a liquid crystal display (LCD) unit 2 at the secondary side of the transformer 1, and its voltage 9*a* is inputted to the inverting input terminal 11*a* of the error amplifier 11 by a voltage/current conversion circuit 10 which converts a current flowing in the discharge tube 9 into a voltage.

The error amplifier 11 outputs to the PWM circuit 8 an output voltage 12 corresponding to the current in the discharge tube 9. The PWM circuit 8 compares the triangular wave output 7 with the output voltage 12 and inputs a pulsed signal 13 to a counter circuit 14.

An output pulsed signal 16 of the oscillation circuit 4 is inputted to the counter circuits 14, 15 and a logic circuit 29. With the output pulsed signal 16 of the oscillation circuit 4 and output pulsed signals of the counter circuits 14, 15, the logic circuit 29 generates gate signals 18, 19, 20 and 21 that are inputted to an H-bridge circuit 17.

The H-bridge 17 is composed such that a series circuit comprising a PMOS (A1) and an NMOS (B2) and a series circuit comprising a PMOS (A2) and an NMOS (B1) are connected to each other in parallel. The H-bridge 17 operates on the gate signals 18, 19, 20 and 21 so that AC current controlled within the frequency range A flows at the primary side of the transformer 1, whereby the discharge tube 9 in the LCD unit 2 is driven with a good power efficiency.

Therefore, a burst circuit 22 (to be described later) does not operate, and if the predetermined voltage Va from the terminal 28*a* is not inputted to the inverting input 11*a*, light is not modulated, the current in the discharge tube 9 is inputted to the inverting input 11*a* of the error amplifier 11, and the discharge tube 9 is feedback-controlled thereby performing a constant-current control within a frequency range for ensuring a good power efficiency.

The operation of the burst circuit 22 for modulating light of the discharge tube 9 will be described.

Figure 2:
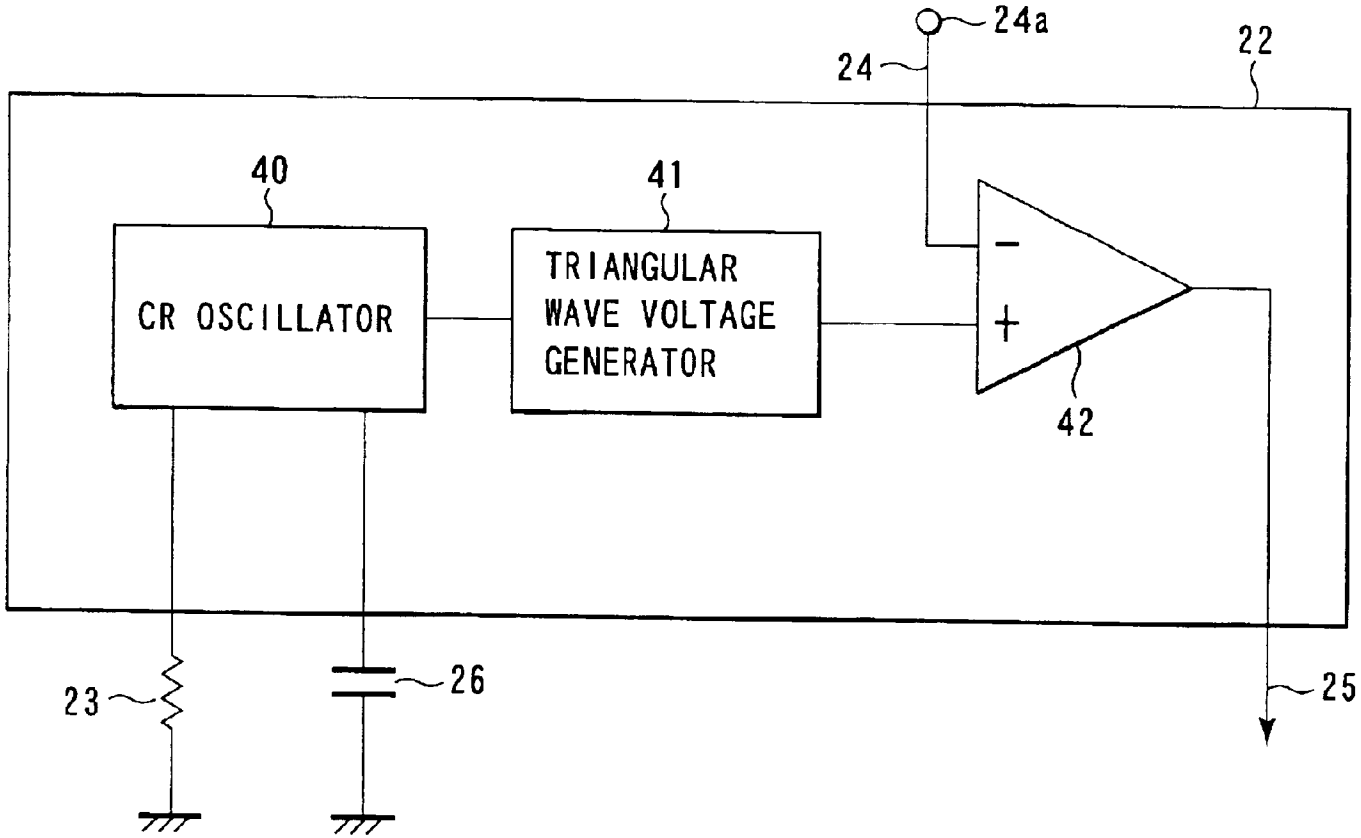
FIG. 2 is a block diagram of a burst circuit used in the inverter circuit for a discharge tube.

Referring to FIG. 2, the burst circuit 22 comprises a CR oscillator 40, a triangular wave voltage generator 41 and a comparator 42, and can be set to either one mode in which a resistance 23 is set to be higher than a predetermined value whereby a predetermined pulsed signal 24 inputted to a duty terminal 24*a* is outputted from the burst circuit 22 as a first burst signal 25*b* (see FIG. 4(D)) or another mode in which the resistance 23 is set to be lower than a predetermined value whereby a triangular wave voltage 27 (see FIG. 4(B)) determined by the resistance 23 and a capacitor 26 and oscillated, and a DC current 36 (see FIG. 4(B)) inputted to the duty terminal 24*a* are compared with each other and a second burst signal 25*a* of the pulse wave (see FIG. 4(C)) is outputted.

When the burst signal 25*b* from the burst circuit 22 is "H (High)", a transistor 28 is turned on, the error amplifier 11 outputs to the PWM circuit 8 the output voltage 12 corresponding to the current in the discharge tube 9, and the H-bridge circuit 17 is operated, whereby the discharge tube 9 is activated with the pulse wave shown FIG. 4(E).

When the burst signal 25*b* from the burst circuit 22 is "L (Low)", the transistor 28 is turned off, the inverting input terminal 11*a* of the error amplifier is pulled up to a predetermined voltage Va applied to a terminal 28*a*, the error amplifier 11 is inactivated, the operation of the H-bridge circuit 17 is stopped, and the discharge tube is inactivated.

Thus, the discharge tube 9 is activated intermittently by the first burst signal 25*b*, and has its light modulated. In the case where the second burst signal 25*a* is used, the discharge tube 9 has its light modulated in the same way, therefore either of the burst signals can be used selectively.

In addition, a signal 33 generated by dividing the voltage at the output side of the transformer 1 through capacitors 31 and 32 is inputted to a protection circuit 30. The protection circuit 30 stops the operation of the logic circuit 29 when the voltage of the signal 33 exceeds a predetermined threshold value, preventing an excessive current from flowing to the discharge tube 9. Since it can happen that the PMOS (A1) and the NMOS (B2) connected to each other in series or the PMOS (A2) and the NMOS (B1) connected to each other in series in the H-bridge circuit 17 are turned on simultaneously when the gate signals 18, 19, 20 and 21 fall simultaneously, a delay circuit 35 is provided.

FIGS. 5(A) to 5(F) show timing charts of gate signals in the inverter circuit for a discharge tube.

Figures 5A, 5B, 5C, 5D, 5E, 5F:
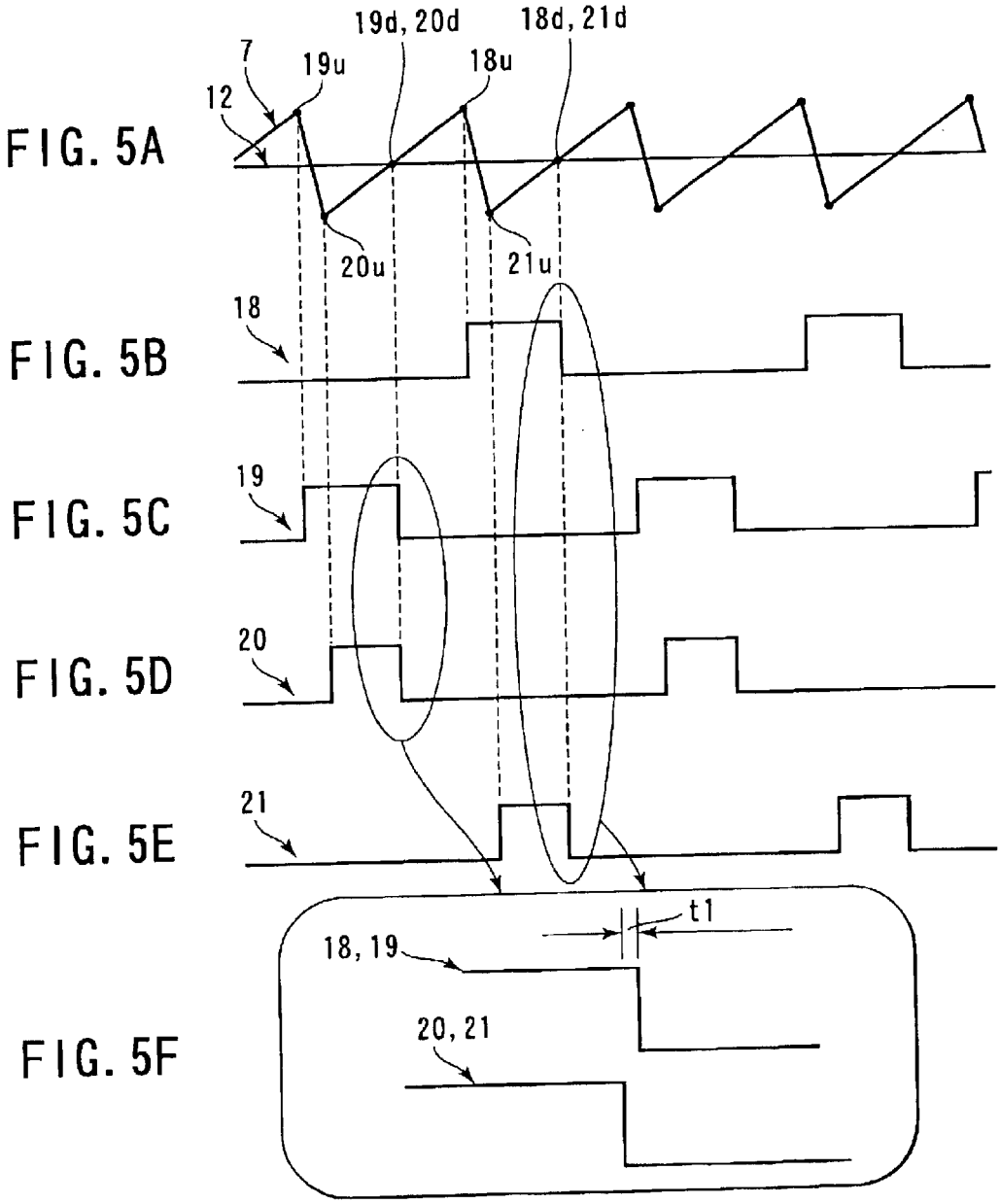
FIGS. 5(A) to 5(F) are timing charts of gate signals in the inverter circuit for a discharge tube of the first embodiment according to the present invention.

Referring to FIGS. 5(A) to 5(C), the gate signal 18 to the PMOS (A1) and the gate signal 19 to the PMOS (A2) are caused to rise by the counter circuits 14 and 15 and the logic circuit 29 at points 18*u* and 19*u*, respectively, which correspond to the maximum peaks of the triangular wave output 7 and which appear alternately with each other and to fall at points 18*d* and 19*d*, respectively, which correspond to the crossings defined by the ascending portions of the triangular wave output 7 and the output voltage 12 of the error amplifier 11 and which appear alternately with each other. The PMOS (A1) and PMOS (A2) are activated by the gate signals 18 and 19, respectively.

Referring to FIGS. 5(A), 5(D) and 5(E), the gate signal 20 to the NMOS (B1) and the gate signal 21 to the NMOS (B2) are caused to rise by the counter circuits 14 and 15 and the logic circuit 29 at points 20*u* and 21*u*, respectively, which correspond to the minimum peaks of the triangular wave output 7 and which appear alternately with each other and to fall at points 20*d* and 21*d*, respectively, which are equal to the points 18*d* and 19*d*, respectively. The NMOS (B1) and NMOS (B2) are activated by the gate signals 20 and 21 respectively.

As will be seen from FIGS. 5(B) to 5(E), the timing of rising of the gate signals 20 and 21 is delayed with respect to that of the gate signals 19 and 18, respectively. On the other hand, the timing of falling of the gate signals 18 and 19 is delayed by a predetermined time t1 by a delay circuit 35 so that the PMOS (A1), PMOS (A2), NMOS (B1) and NMOS (B2) may not turn on simultaneously.

Therefore it becomes easy to generate appropriate gate signals 18, 19, 20 and 21 that do not make the PMOS (A1), PMOS (A2), NMOS (B1) and NMOS (B2) turn on simultaneously, by association of the triangular wave output 7 and the output voltage 12 of the error amplifier 11.

As described above, the inverter circuit for a discharge tube of the first embodiment according to the present invention improves the power efficiency of the transformer, and also suffers from little influence of the high-order frequencies due to the frequency being set to be lower than the resonance frequency, whereby the transformer can be designed easily.

Figure 6:
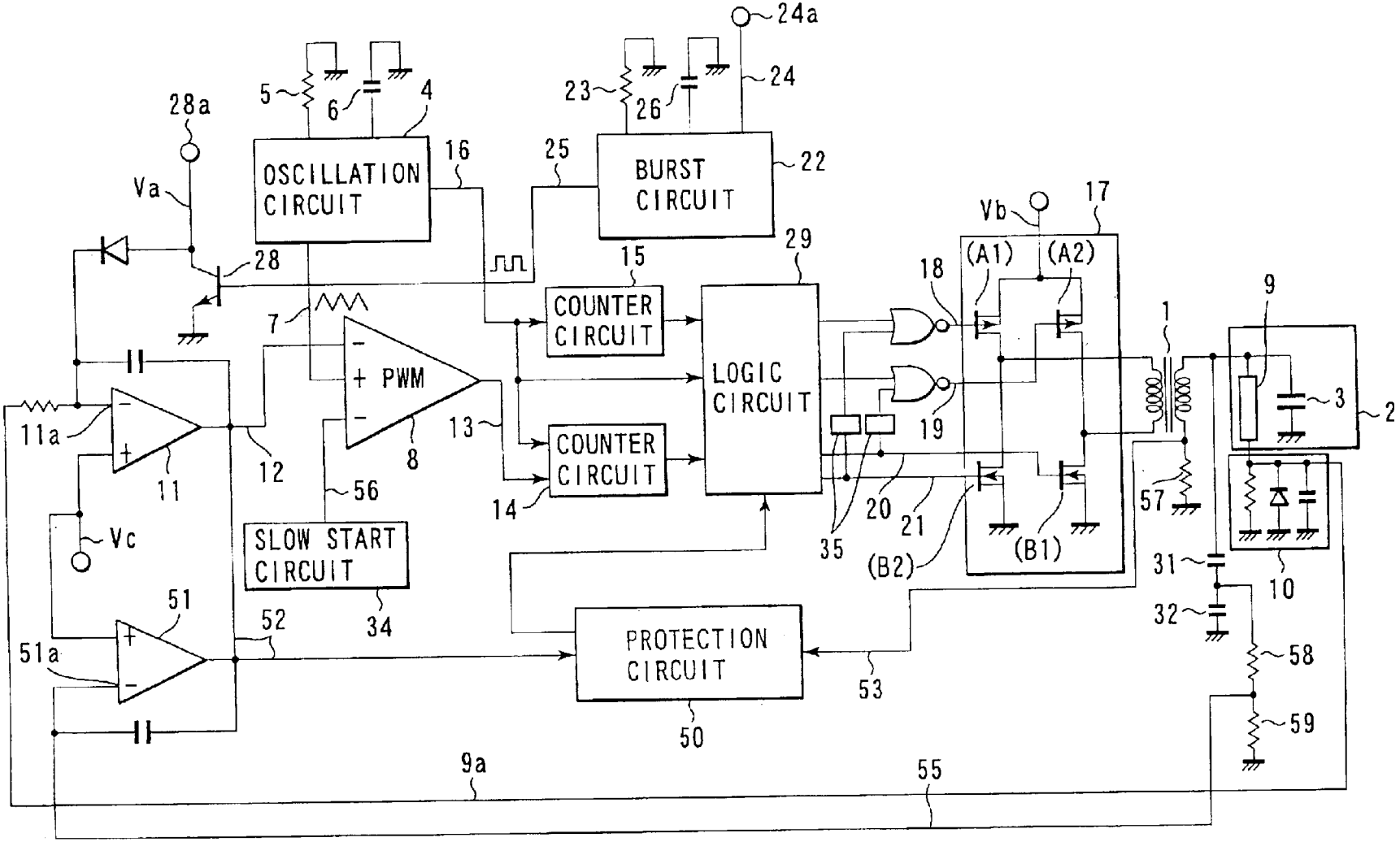
FIG. 6 is a block diagram of an inverter circuit for a discharge tube of a second embodiment according to the present invention.

Referring to FIG. 6 showing the second embodiment according to the present invention, the inverter circuit for a discharge tube includes a voltage feedback error amplifier 51. The voltage feedback error amplifier 51 compares the application voltage signal 55 of the discharge tube 9 inputted to an inverting input terminal 51*a* with the predetermined voltage Vc to output to the PWM circuit 8 an output voltage 52 according to the voltage applied to the discharge tube 9. The application voltage signal 55 is obtained by dividing by resistances 58 and 59 the voltage appearing at the connection point between capacitors 31 and 32 connected in series with the secondary side of the transformer 1. The voltage feedback error amplifier 51 also outputs the output voltage 52 to a protection circuit 50. The protection circuit 50 which includes a comparator circuit is connected to a resistance 57 connected in series with the secondary side of the transformer 1 to receive an output current signal 53 from the transformer 1.

The operation and the circuit arrangement of the inverter for a discharge tube according to the second embodiment is same as those of the inverter circuit according to the first embodiment except the protection circuit 50 and the voltage feedback error amplifier 51 and therefore explanation thereof is omitted.

Now, operation of the protection circuit 50 and the voltage feedback error amplifier 51 of the inverter circuit according to the second embodiment will be explained.

As shown in FIG. 6, the voltage feedback error amplifier 51 compares the application voltage signal 55 inputted to its inverting input terminal 51*a* with the predetermined voltage Vc and outputs an output voltage 52 to the PWM circuit 8, so that feedback control is performed for application of a voltage to the discharge tube 9. With this control, an open voltage to the transformer 1 can be controlled to its predetermined value even in case of, for example, no connection or poor connection of the discharge tube 9 at the output of the transformer 1.

When the output voltage at the secondary side of the transformer 1 can show an abnormal value in case of, for example, no or poor connection of the discharge tube 9, the output voltage 52 of the voltage feedback error amplifier 51 or the output current signal 53 of the transformer 1 is compared with a reference voltage of the comparator circuit included in the protection circuit 50. And if the output voltage 52 or the current signal 53 exceeds the reference voltage of the comparator, the protection circuit 50 stops the operation of the logic circuit 29, thereby preventing an overcurrent from flowing into the discharge tube 9 or an over-voltage from being generated by the transformer 1.

A slow start circuit 34 outputs a relatively slowly increasing start drive signal 56 to the PWM circuit 8 in order to prevent an overvoltage from being instantly generated at a time of start of the circuit. In consideration of instant generation of such overvoltage due to some cause at a time of start of the circuit, the protection circuit 50 may be designed in such a manner that the logic circuit 29 is caused to stop its operation, when the output voltage 12 of the error amplifier 11 or the output voltage 52 of the voltage feedback error amplifier 51 exceeds a predetermined value after a predetermined time set by a built-in timer and that the logic circuit 29 is prevented accidentally from ceasing its operation.

The protection circuit 50 also functions to cease the operation of the logic circuit 29 when the output current signal 53 of the transformer 1 exceeds a predetermined value which falls out of its normal range. In this way, the transformer 1 and these circuits are protected from being damaged.

According to the second embodiment of the present invention, in addition to the technical advantages obtained by the first embodiment, it is easily possible to prevent an overcurrent from flowing in the discharge tube 9 or an overvoltage from being generated by the transformer 1 and also to prevent any damages to the transformer 1 and all the circuits.

While the illustrative and presently preferred embodiments of the present invention have been described in detail herein, it is to be understood that the inventive concepts may be otherwise variously embodied and employed and that the appended claims are intended to be construed to include such variations except insofar as limited by the prior art.

What is claimed is:

1. An inverter circuit for a discharge tube, comprising:

an electromagnetic transformer having a primary side and a secondary side, the secondary side being connected to a discharge tube, wherein the transformer includes a resonance circuit composed of a parasitic capacitance of the discharge tube; and a H-bridge circuit connected to the primary side of the transformer, wherein the H-bridge circuit is configured to generate an AC signal which drives the primary side of the transformer, wherein the AC signal has a phase difference between its voltage component and its current component, and wherein the AC signal has a frequency that is lower than a resonance frequency of the resonance circuit, and wherein the AC signal frequency is also within a range of frequencies corresponding to frequencies at which the phase difference for the AC signal is not more than −30° from a minimum phase difference for the AC signal.

2. An inverter circuit for a discharge tube according to claim 1 further comprising:

an oscillation circuit configured to determine the frequency of the AC signal.

3. An inverter circuit for a discharge tube according to claim 2, further comprising a burst circuit for outputting a predetermined burst signal, whereby the primary side of the transformer is driven intermittently.

4. An inverter circuit for a discharge tube according to claim 3, wherein a burst circuit outputs an inputted pulsed signal as a burst signal when a resistance that determines an oscillating frequency is set to be higher than a predetermined value, and outputs a burst signal obtained from a predetermined DC signal and an oscillated triangular wave when the resistance is set to be lower than a predetermined value.

5. An inverter circuit for a discharge tube according to claim 4, wherein when the burst signal is high, an inverting input of an error amplifier for feedback-controlling a current of the discharge tube is pulled up, whereby the primary side of the transformer is inactivated.

6. An inverter circuit for a discharge tube according to claim 5, wherein the H-bridge circuit is composed such that two series circuits each comprising a PMOS and an NMOS are connected to each other in parallel, gates of two NMOSs are caused to fall at respective two points which correspond to crossings defined by ascending portions of a predetermined triangular wave output and a voltage output of the error amplifier and which appear alternately with each other, and that gates of two PMOSs are caused to fall lagging behind falling of the gates of the two NMOSs.

7. An inverter circuit for a discharge tube according to claim 5, further comprising a protection circuit for inactivating the H-bridge circuit when an output voltage of the error amplifier exceeds a predetermined value.

8. An inverter circuit for a discharge tube according to claim 7, wherein the predetermined value is a reference voltage of a comparator of the protection circuit.

9. An inverter circuit for a discharge tube according to claim 3, wherein when the burst signal is high, an inverting input of an error amplifier for feedback-controlling a current of the discharge tube is pulled up, whereby the primary side of the transformer is inactivated.

10. An inverter circuit for a discharge tube according to claim 2, wherein the H-bridge circuit is composed such that two series circuits each comprising a PMOS and an NMOS are connected to each other in parallel, and a delay circuit is connected to gate circuits of the PMOSs.

11. An inverter circuit for a discharge tube according to claim 2, wherein the H-bridge circuit is composed such that two series circuits each comprising a PMOS and an NMOS are connected to each other in parallel, and gates of two PMOSs are caused to rise at respective two points which correspond to maximum peaks of a predetermined triangular wave output and which appear alternately with each other while gates of two NMOSs are caused to rise at respective two points which correspond to minimum peaks of the triangular wave output and which appear alternately with each other.

12. An inverter circuit for a discharge tube according to claim 2, further comprising a protection circuit for inactivating the H-bridge circuit when an output of the transformer exceeds a predetermined value.

13. An inverter circuit for a discharge tube according to claim 2, further comprising a voltage feedback error amplifier for feedback-controlling an output voltage of the transformer.

14. An inverter circuit for a discharge tube according to claim 13, further comprising a protection circuit for inactivating the H-bridge circuit when an output voltage of the voltage feedback error amplifier exceeds a predetermined value.

15. An inverter circuit for a discharge tube according to claim 2 further comprising:

a logic circuit configured to generate a signal input to the H-bridge circuit.

16. An inverter circuit for a discharge tube comprising:

a transformer which includes a resonance circuit composed of a parasitic capacitance of a discharge tube;

a H-bridge circuit which drives a primary side of the transformer at a frequency that is lower than a resonance frequency of the resonance circuit and that involves a phase difference between a voltage and a current at the primary side of the transformer, the phase difference falling within a predetermined range from its minimum point; and a burst circuit that outputs an inputted pulsed signal as a burst signal when a resistance that determines an oscillating frequency is set to be higher than a predetermined value, and outputs a burst signal obtained from a predetermined DC signal and an oscillated triangular wave when the resistance is set to be lower than a predetermined value.

17. An inverter circuit for a discharge tube according to claim 16, wherein the burst circuit is configured to output a predetermined burst signal, whereby the primary side of the transformer is driven intermittently.

18. An inverter circuit for a discharge tube according to claim 17, wherein when the burst signal is high, an inverting input of an error amplifier for feedback-controlling a current of the discharge tube is pulled up, whereby the primary side of the transformer is inactivated.

19. An inverter circuit for a discharge tube according to claim 18, wherein the H-bridge circuit is composed such that two series circuits each comprising a PMOS and an NMOS are connected to each other in parallel, gates of two NMOSs are caused to fall at respective two points which correspond to crossings defined by ascending portions of a predetermined triangular wave output and a voltage output of the error amplifier and which appear alternately with each other, and that gates of two PMOSs are caused to fall lagging behind falling of the gates of the two NMOSs.

20. An inverter circuit for a discharge tube according to claim 18, further comprising a protection circuit for inactivating the H-bridge circuit when an output voltage of the error amplifier exceeds a predetermined value.

21. An inverter circuit for a discharge tube according to claim 20, wherein the predetermined value is a reference voltage of a comparator of the protection circuit.

22. An inverter circuit for a discharge tube comprising:

a transformer which includes a resonance circuit composed of a parasitic capacitance of a discharge tube; and a H-bridge circuit which drives a primary side of the transformer at a frequency that is lower than a resonance frequency of the resonance circuit and that involves a phase difference between a voltage and a current at the primary side of the transformer, the phase difference falling within a predetermined range from its minimum point; and wherein the H-bridge circuit is composed such that two series circuits each comprising a PMOS and an NMOS are connected to each other in parallel, and a delay circuit is connected to gate circuits of the PMOSs.

23. An inverter circuit for a discharge tube comprising:

a transformer which includes a resonance circuit composed of a parasitic capacitance of a discharge tube; and a H-bridge circuit which drives a primary side of the transformer at a frequency that is lower than a resonance frequency of the resonance circuit and that involves a phase difference between a voltage and a current at the primary side of the transformer, the phase difference falling within a predetermined range from its minimum point; and wherein the H-bridge circuit is composed such that two series circuits each comprising a PMOS and an NMOS are connected to each other in parallel, and gates of two PMOSs are caused to rise at respective two points which correspond to maximum peaks of a predetermined triangular wave output and which appear alternately with each other while gates of two NMOSs are caused to rise at respective two points which correspond to minimum peaks of the triangular wave output and which appear alternately with each other.

24. An inverter circuit for a discharge tube comprising:

a transformer which includes a resonance circuit composed of a parasitic capacitance of a discharge tube;

a H-bridge circuit which drives a primary side of the transformer at a frequency that is lower than a resonance frequency of the resonance circuit and that involves a phase difference between a voltage and a current at the primary side of the transformer, the phase difference falling within a predetermined range from its minimum point;

a voltage feedback error amplifier for feedback-controlling an output voltage of the transformer; and a protection circuit for inactivating the H-bridge circuit when an output voltage of the voltage feedback error amplifier exceeds a predetermined value.

25. An inverter circuit for a discharge tube comprising:

a transformer which includes a resonance circuit composed of a parasitic capacitance of a discharge tube;

a H-bridge circuit which drives a primary side of the transformer at a frequency that is lower than a resonance frequency of the resonance circuit and that involves a phase difference between a voltage and a current at the primary side of the transformer, the phase difference falling within a predetermined range from its minimum point; and a protection circuit for inactivating the H-bridge circuit when an output of the transformer exceeds a predetermined value.

* * * * *